United States Patent [19]

Sekiguchi

[11] 4,193,754

[45] Mar. 18, 1980

[54] VIBRATING APPARATUS FOR FORMING CONCRETE BLOCKS

[75] Inventor: Yoji Sekiguchi, Maebashi, Japan

[73] Assignee: Katsura Machine Co., Ltd., Maebashi, Japan

[21] Appl. No.: 926,816

[22] Filed: Jul. 21, 1978

[30] Foreign Application Priority Data

Jul. 26, 1977 [JP] Japan ..... 52-89443

[51] Int. Cl.[2] ..... B28B 1/08

[52] U.S. Cl. ..... 425/424; 425/146; 425/404; 425/421; 425/422; 425/432; 425/456

[58] Field of Search ..... 425/424, 146, 404, 421, 425/422, 432, 444, 456

[56] References Cited

U.S. PATENT DOCUMENTS 2,057,466 10/1936 Willetts ..... 425/424

*Primary Examiner*—Donald J. Arnold

*Attorney, Agent, or Firm*—Fleit & Jacobson

[57] ABSTRACT

A vibrating apparatus for forming a concrete block by a vibration compaction method. The apparatus has a mold box for contouring a concrete block to be produced, a receiving plate which is detachably and resiliently attached to the bottom of the mold box, a device for vibrating the mold box, and an air spring device which permits a close and resilient contact between the mold box and the receiving plate. This close contact permits the receiving plate to effectively follow the vibration of the mold box. The vibration of the mold box is effectively transmitted to the concrete block material.

6 Claims, 3 Drawing Figures

VIBRATING APPARATUS FOR FORMING CONCRETE BLOCKS

BACKGROUND OF THE INVENTION

The present invention relates generally to an apparatus for forming concrete blocks, and more particularly to a vibrating apparatus for forming a concrete block in a mode of vibration compaction.

A conventional vibrating apparatus has a platform which is elevated in the vertical direction by means of a hydraulic cylinder or the like. The platform has a resilient layer made of resilient material such as rubber on the upper surface thereof. The resilient layer is fixed to the platform. A receiving plate which receives a concrete block to be formed is positioned on the resilient layer of the platform. On the plate is disposed a mold box which has a vibrating device which generally comprises eccentric weights, shafts and devices for driving or rotating the shafts, thereby causing a vibration of the mold box.

In the conventional vibrating apparatus described above, the hydraulic cylinder or the like is driven at first to elevate the platform to thereby secure the receiving plate and the mold box in position. After the plate as well as the mold box is secured in position, concrete material is fed to the mold box by a suitable feeding device. While the concrete material is being fed to the mold box, the vibrating device is driven to vibrate the mold box in the vertical direction to thereby accomplish vibration compaction. After the concrete material is fully fed to the mold box, the vibrating device is continuously driven, and at the same time a compression molding press, which is installed above the mold box and has a plate, is driven to lower the plate to compression-mold a concrete block. After the compression molding is completed, the plate of the compression molding press and the receiving plate are lowered with the distance therebetween being maintained. Namely, the plate of the compression molding press and the platform connected to the hydraulic cylinder or the like are simultaneously lowered at the same speed. In this instance, the mold box abuts against, and is received by, shoulders which are disposed below the mold box. Thus, the mold box stops at the predetermined position and is not lowered any further. While the mold box is received by the shoulders so that the same is not lowered any further, the compression molding press and the hydraulic cylinder or the like are continuously driven to lower further the molded concrete block, receiving plate and the platform. Thus, the concrete block is removed from the mold box and is then delivered to a predetermined position.

The above described conventional vibration device aims to allow a vibration from the mold box to the concrete material by way of the receiving plate. Here, it is considered that compaction effect of the material is proportional to a vibration accleration of the mold box However, the conventional vibration device has serious disadvantages in that (a) a filling or packing density is not desirably high and filling time is long because the vibration of the mold box is decreasingly transmitted to the materials for a concrete block within the mold box; (b) a great noise is produced due to a successive abutment and separation between the mold box and the receiving plate; and (c) the resulting products are poor in finish particularly bottom edges thereof. The inventor has found that these disadvantages are due to the fact that the receiving plate cannot follow the vibration of the mold box because a vibration acceleration of the mold box exceeds, in general, a vibration accleration of the receiving plate, the latter being produced by the resilient force of the resilient layer of the platform.

The above-described disadvantages are unavoidable with respect to the conventional device, and are more conspicuous when the apparatus becomes larger. Namely, as weight of the receiving plate becomes greater, it becomes further difficult to obtain a close contact between the receiving plate and the mold box, and this difficulty results in disadvantages as described above.

SUMMARY OF THE INVENTION

Accordingly, an object of the present invention is to provide an improved vibration apparatus for forming a concrete block in a vibration compaction mode.

Another object of the present invention is to provide a vibrating apparatus in which a receiving plate can present a vibration which can follow a vibration of the mold box so that the receiving plate may be fully contacted with the mold box.

Briefly, the vibrating apparatus of the present invention comprises an air sprung device which forcibly and resiliently presses the mold box downward. The air spring device makes the resilient force of the aforementioned resilient layer become large enough to provide a sufficient vibration acceleration to the receiving plate.

Other objects and features of the present invention will become apparent from the detailed description of preferred embodiments thereof, which will be read with reference to the accompanying drawings, in which.

DETAILED DESCRIPTION OF PREFERRED EMBODIMENTS

Figure 1:
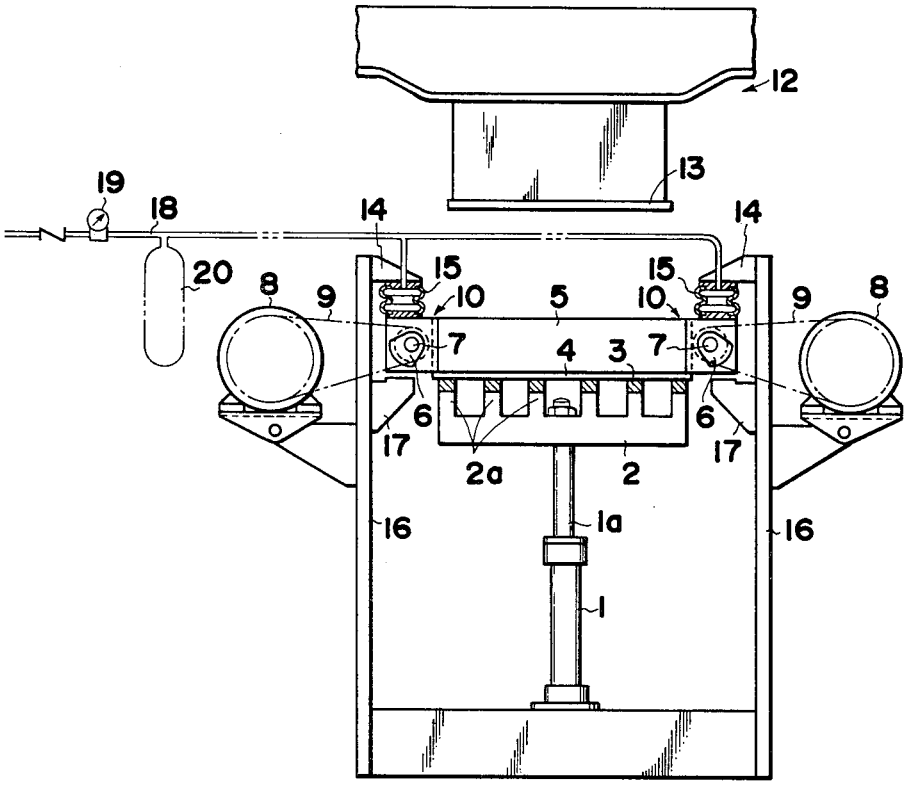
FIG. 1 is a schematic side view of a vibrating apparatus according to an embodiment of the present invention.
Figure 2:
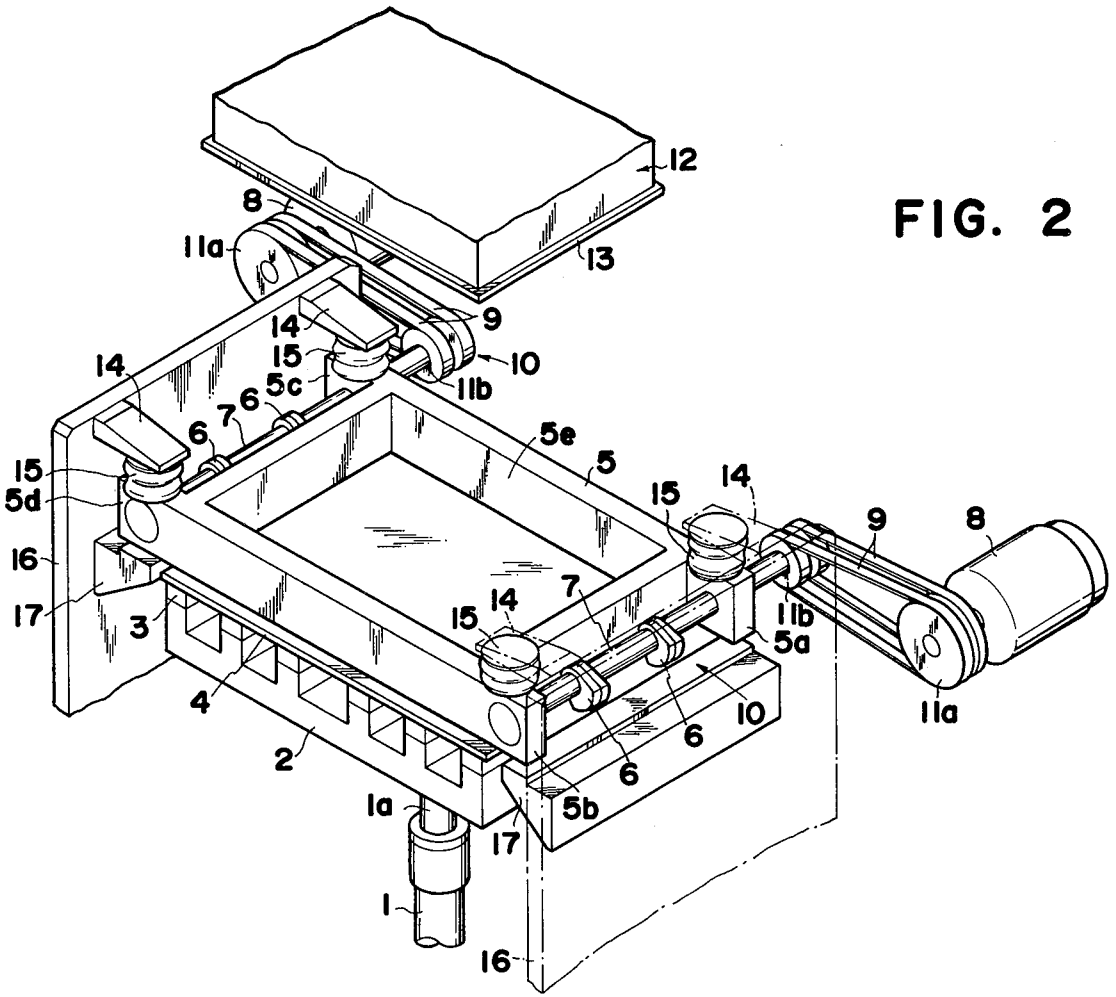
FIG. 2 is a perspective view of the apparatus shown in FIG. 1.

In the drawings, like reference numerals represent like parts. With reference to FIGS. 1 and 2, a hydraulic cylinder device 1 having a piston rod 1*a* is installed in a vertical manner. The rod 1*a* is connected at its upper end to a platform 2 in such a manner that the platform is horizontal. The platform 2 has a plurality of legs 2*a* which extend upward in a vertical manner. The legs 2*a* have a horizontal and coincided flat surface of the upper end thereof. On the upper surface of the legs of the platform 2 is disposed a resilient layer 3 which is made of high resilient materials such as rubber. The resilient layer 3 is fixed to the upper surface of the legs 2*a* and has a flat and coincided surface. A receiving plate 4, which is designed to receive a concrete block to be formed, is positioned on the resilient layer 3.

The resilient plate 4 has flat upper and lower surfaces, and is closely contacted with the resilient layer 3.

A mold box 5 is positioned on the receiving plate 4. The mold box is composed of parallel long beams and parallel short beams, the latter being perpendicularly connected with the former to form a rectangular structure with projections 5*a*–5*d* at the corners of the mold box and an opening 5*e*. The mold box 5 has vibrating devices, which are generally illustrated at 10, at the opposite sides thereof. The vibrating devices disposed at the opposite sides are quite similar in structure and operation with each other, and for this reason one of them will be described with reference to FIG. 2. A shaft 7 is rotatably connected to the projections 5*a*, and 5*b* of the mold box 5 and is extended through the projection 5*a*. The shaft 7 has eccentric weight members 6 fixedly connected therewith so that the eccentric weight members 6 as well as the shaft 7 may be rotated by a motor 8 through an endless belt 9 and pulleys 11*a*, 11*b*.

Above the mold box 5 is disposed a compression molding device 12 which has a pressing plate 13 at the lower end thereof. The compression molding device 12 is installed such that the pressing plate 13 may coincide in a vertical relation with the opening 5*a* of the mold box 5.

Air springs 15 are disposed on the projections 5*a*–5*d* of the mold box 5. The air springs 15 shown in FIG. 2 are of bellows type which the inventor has found to be more desirable in this invention rather than other types of air spring such as diaphragm type or combined type of bellows and diaphragm. The air springs 15 are connected at the upper ends thereof to arms 14, which are fixed to a predetermined position of a frame work 16 of the apparatus. The bottom of the air springs 15 is contacted with the projections 5*a*–5*d* of the mold box 5. The bellows type air spring 15 should be those in which the rubber closure film which forms bellows is telescoped without any inverse of the rubber film.

In general, an air spring presents such advantageous characteristic that much larger amount of energy can be absorbed in comparison with metal spiral springs. This advantage cannot be obtained by a metal spiral spring in which energy to be absorbed is decreased when spring constant thereof is lowered. Therefore, air springs 15 are adopted in this invention.

The air springs 15 are connected to an air compressor (not shown) through a piping 18 as illustrated in FIG. 1. An air pressure controlling valve 19 and an air reservoir 20 are connected to the piping 18 so as to change, if necessary, characteristics of the air springs.

The frame work 16 has receiving blocks 17 which are connected to the predetermined inside position of the frame work in the same horizontal level. The receiving blocks 17 are extended in the opposite direction with each other so that they can receive the projections 5*a*–5*d* of the mold box 5 to hold the mold box 5 in position.

Figure 3:
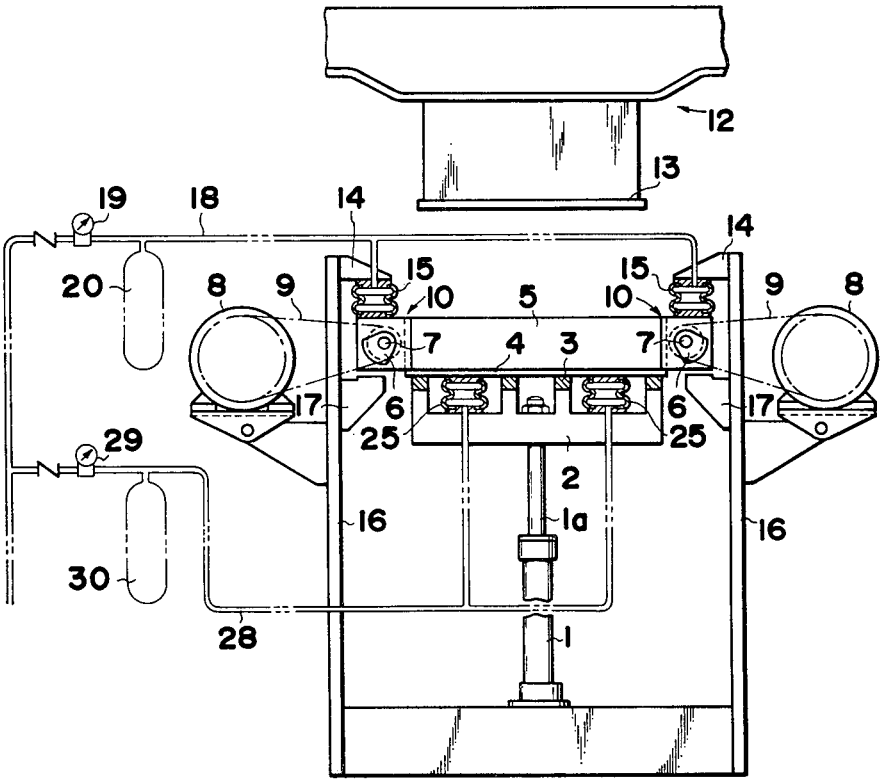
FIG. 3 is a schematic side view of a vibrating apparatus according to another embodiment of the invention.

In FIG. 3 which shows another embodiment of the present invention, additional bellows type air springs 25, which are quite similar in structure with the aforementioned air springs 15, are provided in place of some part of the resilient layer 3 between the platform 2 and the receiving plate 3. The additional air springs 25 are connected to the aforementioned air compressor (not shown) through piping 28. The piping 28 has an air pressure controlling valve 29 and an air reservoir 30 so that characteristics of the additional air springs 25 can be changed when necessary. The additional air springs 25 cooperate with the resilient layer 3 and can prevent the resilient layer 3 from being excessively deformed. Other elements and structure are similar with those of the embodiment of FIGS. 1 and 2, and for this reason any further detailed description will not be made.

In operation of the apparatus in the first embodiment shown in FIGS. 1 and 2, the hydraulic cylinder 1 is driven to elevate the platform 2 so that the mold box 5 which was secured on the receiving blocks 17 of the frame work 16 is moved upward, together with the resilient layer 3 and the receiving plate 4 against the resilient force of the air springs 15. After the mold box 5 and its detachable base, namely the receiving plate 4, are supported in position by the actuation of the hydraulic cylinder 1 and the air springs 15, materials for a concrete block are fed into the mold box 5 by a known feeder (not illustrated). At the same time, the vibrating device 10 is driven to vibrate the mold box 5. Namely, while the materials for a concrete block are being fed into the mold box 5, the motors 8 are driven to rotate the shafts 7 and the eccentric weight members 6 so as to apply a vertical vibration to the mold box 5. At this time the mold box 5 is resiliently pressed by the air springs 15 and the resilient layer 3 so that the mold box 5 is closely and firmly contacted with the receiving plate 4. Therefore, the mold box 5 can be followed by the vibration of the receiving plate 4. This means that the vibration of the mold box 5 can be effectively transmitted to the concrete block materials. Thus, packing density of the concrete block materials becomes higher, and a desired vibration compaction is accomplished.

After the vibration compaction is finished to thereby form a desired concrete block, the hydraulic cylinder 1 and the molding press 12 are simultaneously driven so that the pressing plate 13 of the molding press 12 and the piston rod 1*a* of the hydraulic cylinder 1 are simultaneously lowered at the same speed.

By the simultaneous operation of the molding press 12 and the hydraulic cylinder 1 at the same speed, the mold box 5 is received by, and abutted against, the receiving blocks 17. A further continuous operation of the hydraulic cylinder 1 and the molding press, namely lowering of the plate 13 and the piston rod 1*a*, forcibly remove the completed concrete block (not shown) from the mold box 5. The concrete block removed from the mold box is then delivered to a predetermined position by means of a suitable feeding device, though not illustrated.

An operation of the structure having additional air springs 25 as shown in FIG. 3 will be apparent from the foregoing, and any detailed description will not be made. The additional air springs 25 prevent an excessive deformation of the resilient layer 3.

According to the vibrating apparatus of the present invention, following outstanding advantages are obtained:

(a) since vibration of the mold box 5 can be effectively transmitted to the materials for a concrete block, a product of high packing density can be obtained efficiently and the production time can be shortened;

(b) since a very close contact can be established between the mold box 5 and the receiving plate 4, desired finishing of the product can be obtained particularly at bottom edges of the product; and (c) a noise which is inherent to the conventional apparatus and is generated by continuous separation/abutment between the mold box and the receiving plate can be lessened because the mold box and the receiving member are closely contacted with each other when same are vibrated.

Though the present invention has been described with reference to the preferred embodiments, many modifications and alterations can be made within the spirit of the present invention.

What is claimed is:

1. Vibrating apparatus for forming a concrete block comprising:

(a) a framework which has arms at opposite sides thereof and receiving blocks at a portion lower than said arms with a predetermined distance between said arms and said receiving blocks;

(b) a four-sided mold box for forming a concrete block;

(c) a receiving plate at the bottom of said mold box;

(d) a platform which has a resilient layer thereon, said mold box being vertically movable and held in position by said receiving plate and said platform;

(e) air spring means for resiliently pressing said mold box downwardly;

said air spring means having a plurality of bellows, each of which is disposed at the bottom of said arms of the framework, (f) a hydraulic cylinder means for pressing said platform and said receiving plate upwardly above said receiving blocks such that said receiving plate is closely contacted with said mold box against the resilient force of said air spring means;

(g) means for vibrating said mold box, said means for vibrating the mold box having a shaft rotatably connected to said mold box, an eccentric weight member connected to said shaft, and driving device for rotating said shaft.

2. The vibrating apparatus according to claim 1, which said apparatus further comprises additional air spring means which is of bellows like structure, said additional air spring means being positioned between said receiving plate and said platform.

3. The vibrating apparatus according to claim 1, in which said apparatus further comprises a pressing device which presses the concrete block in the downward direction in communication with a lowering operation of said hydraulic cylinder means, thereby removing the concrete block from said mold box.

4. Vibrating apparatus according to claim 1, in which said mold box is positioned between said arms and said receiving blocks, said mold box being supported above said receiving blocks by actuation of said hydraulic cylinder means, said mold box being positioned on the receiving blocks at least when complete blocks are removed from said mold box.

5. Vibrating apparatus according to claim 1, in which said platform has a plurality of legs which extend upwards in a vertical manner, said legs having horizontal flat surfaces on the extremity thereof, said resilient layer being disposed on said flat surfaces of the legs.

6. Vibrating apparatus according to claim 5, in which said mold box has projections at the corners thereof, said eccentric weight member being disposed at said projections, said receiving blocks being extended in the opposite direction to thereby receive said projections of the mold box.

* * * * *